United States Patent [19]

Mitchell et al.

[11] Patent Number: 4,519,727

[45] Date of Patent: May 28, 1985

[54] OFFSHORE WELL HEAD PROTECTOR AND METHOD OF INSTALLATION

[75] Inventors: Stewart D. Mitchell, Udny Green; Steven A. Wheeler, Westhill, both of Scotland

[73] Assignee: Texaco Limited, London, England

[21] Appl. No.: 531,884

[22] Filed: Sep. 14, 1983

[51] Int. Cl.[3] ..... E02B 17/02; E21B 33/037

[52] U.S. Cl. ..... 405/204; 166/335; 405/211; 405/227

[58] Field of Search ..... 405/195, 204, 211, 224, 405/227; 166/335, 338

[56] References Cited

U.S. PATENT DOCUMENTS

| | | | |
|---|---|---|---|
| 3,910,056 | 10/1975 | Dopyera | 405/211 |
| 4,007,598 | 2/1977 | Tax | 405/204 X |
| 4,155,672 | 5/1979 | Franks | 405/211 |
| 4,273,472 | 6/1981 | Piazza et al. | 405/211 |

FOREIGN PATENT DOCUMENTS

| | | | |
|---|---|---|---|
| 2068439 | 8/1981 | United Kingdom | 405/204 |

*Primary Examiner*—David H. Corbin

*Attorney, Agent, or Firm*—Robert A. Kulason; Robert B. Burns

[57] ABSTRACT

A well head protector for a well which is located at the floor of an offshore body of water. The protector includes a plurality of discrete sub-assemblies which, for installation purposes, are initially transported to a drilling vessel and positioned above the well head. The sub-assemblies are sequentially lowered from the vessel deck and assembled above the water surface into a composite unit. The completed unit is guidably lowered by the vessel's drilling derrick to its position surrounding the well head. The deflecting elements are then lowered into place.

24 Claims, 10 Drawing Figures

FIG. 8.
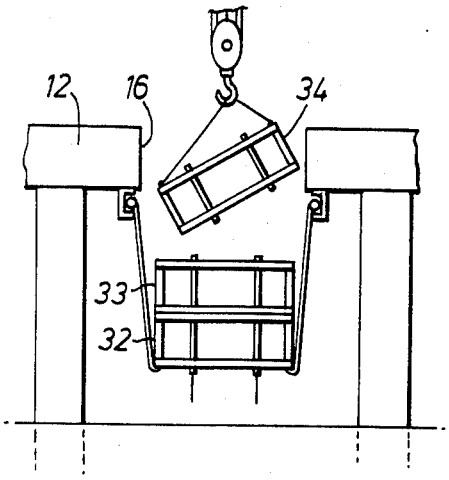
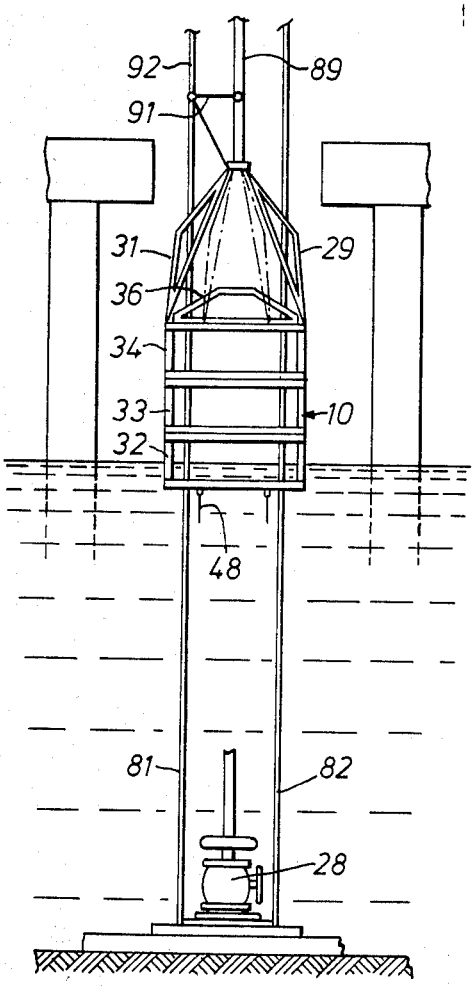
FIG. 9.

OFFSHORE WELL HEAD PROTECTOR AND METHOD OF INSTALLATION

BACKGROUND OF THE INVENTION

Many wells for the production of crude oil and gas are located in offshore waters. These wells can be found in inland waters as well. However, in the continuing search for petroleum reserves, the offshore type well is used most frequently in petroleum reserves found further and further from shore.

Often, where a highly productive offshore field is discovered, a number of wells will be drilled into the area, each being furnished with a well head which protrudes just above the ocean floor. Often in a highly productive area, these well heads are judiciously spaced and interconnected through suitable manifolding or preferably through pipelines. The latter are generally directed to a common assembly point such as a collecting platform set at a central location, and provided with means to receive and initially treat the petroleum product.

The nature of the ordinary well head is such that it embodies sufficient control means that the well can be adjusted to safely produce at a desired rate. Depending on the type of well being utilized, the well head itself can assume different proportions and embody varying forms of equipment adapted to the particular subsea conditions.

In either instance, the well head is generally set on a pad which in turn is piled to the ocean floor. Physically the well head extends upwardly from the pad for a sufficient distance to provide the necessary producing requirements.

A further feature of the well head is that it must accommodate workover tools and instruments which are periodically inserted into the well for various reasons. The well head therefore constitutes an essential part of the producing function and is a highly important piece of equipment.

Since offshore wells are located in many different water depths, they are subject to damaging effects peculiar to the particular area. These danger sources include not only the peril of underwater objects which might be floated into contact with the well head, but also objects which are dropped or lowered from the surface.

A primary source of damage to a well head resides in the fishing nets and trawling boards equipment used by commercial fishermen who fish the water in the vicinity of the wells. These nets can be highly damaging to a well head when they become entangled. Further, they are capable of severely bending, or at least inflicting minor damage to well head parts. The latter, although built for strength, are nonetheless susceptible to being distorted when subjected to a severe pulling force.

Another source of possible danger to offshore wells stems from the use of anchors and anchor chains. It can be appreciated that in the instance of a heavy chain, the latter could become snagged or at least partially wrapped around a part of the well head. Thus, when the chain is retrieved, it could distort or even break parts from the well head.

The undesirable consequence of such an underwater emergency would be an uncontrolled flow of the crude oil or gas. There have been instances for example when well heads have been damaged by anchor chains to the point where the well has become unusable.

It has therefore become a desirable, if not mandatory, practice to provide some form of protective coverage for exposed sea bottom well heads. Preferably, such protective units are designed to deflect or deter damaging contact between a well head and heavy moving objects or lines. Thus, a protector's primary function is to permit the well head to operate in a safe manner and yet be readily accessible for workover purposes and/or for diver inspection.

One problem that arises during the positioning of well head protectors is the difficulty encountered in accurately lowering the protector from a floating vessel to bring it properly about the well head. This lowering function can be hazardous, and is always expensive. For example, unless the condition of the ocean is relatively calm, and the vessel subjected to a minimal degree of movement, lowering of the well head protector over one side or the aft end, even with the aid of guide cables, can be uncertain and hazardous.

Installing a well head protector is not a simple operation and normally requires the use of special derrick equipped vessels which are capable of transporting the protector as a unit to the well site and thereafter lowering it over one side. The daily rental cost of such vessels can be exorbitant and in the instance of bad weather the mere rental of the vessel while waiting for favorable conditions, can constitute a substantial expense.

To overcome the foregoing problems, there is presently provided a well head protector which is sufficiently heavy to perform its designed function, and yet can be readily installed at a subsea location. The protector is thus initially fabricated into discrete sub-assemblies which can be easily transported to an offshore drilling vessel located above the well head.

The individual protector parts are assembled at the vessel into a singular unitary structure as the latter is progressively lowered beneath the vessel. This avoids the necessity for putting the protector together on the vessel deck. In one embodiment, the vessel is of the semi-submersible type which is adapted for deep water drilling. Thus, its deck can be raised and lowered in the water by controllable buoyancy tanks.

With the protector fully assembled, it can be conveniently lowered by the vessel's drilling equipment to the well head, by way of guide wires which extend to the latter from the vessel. The protector, during the lowering operation, is supported from the drilling vessel's derrick and/or drill string and is laterally restrained by guide lines.

It is therefore an object of the invention to provide a well head protector, and a method for installing the latter about a well head located at the ocean floor. A further object is to provide a well head protector that can be readily assembled into a unitary structure after the discrete parts thereof have been transported to an offshore well head site. A still further object is to provide the means, and a method for assembling and lowering a well head protector from a drilling vessel located at the site of a well head to be covered.

DESCRIPTION OF THE DRAWINGS

FIGS. 6 to 10 illustrate the progressive steps of installing the protector in an offshore body of water, onto a well head.

FIG. 1 illustrates the disclosed well head protector 10 in its environment at the floor of a body of water. The marine vehicle 11 utilized for installing the protector is preferably a drilling vessel 11 of the semi-submersible type which is capable of being anchored or otherwise held in place at the water's surface.

Figure 1:
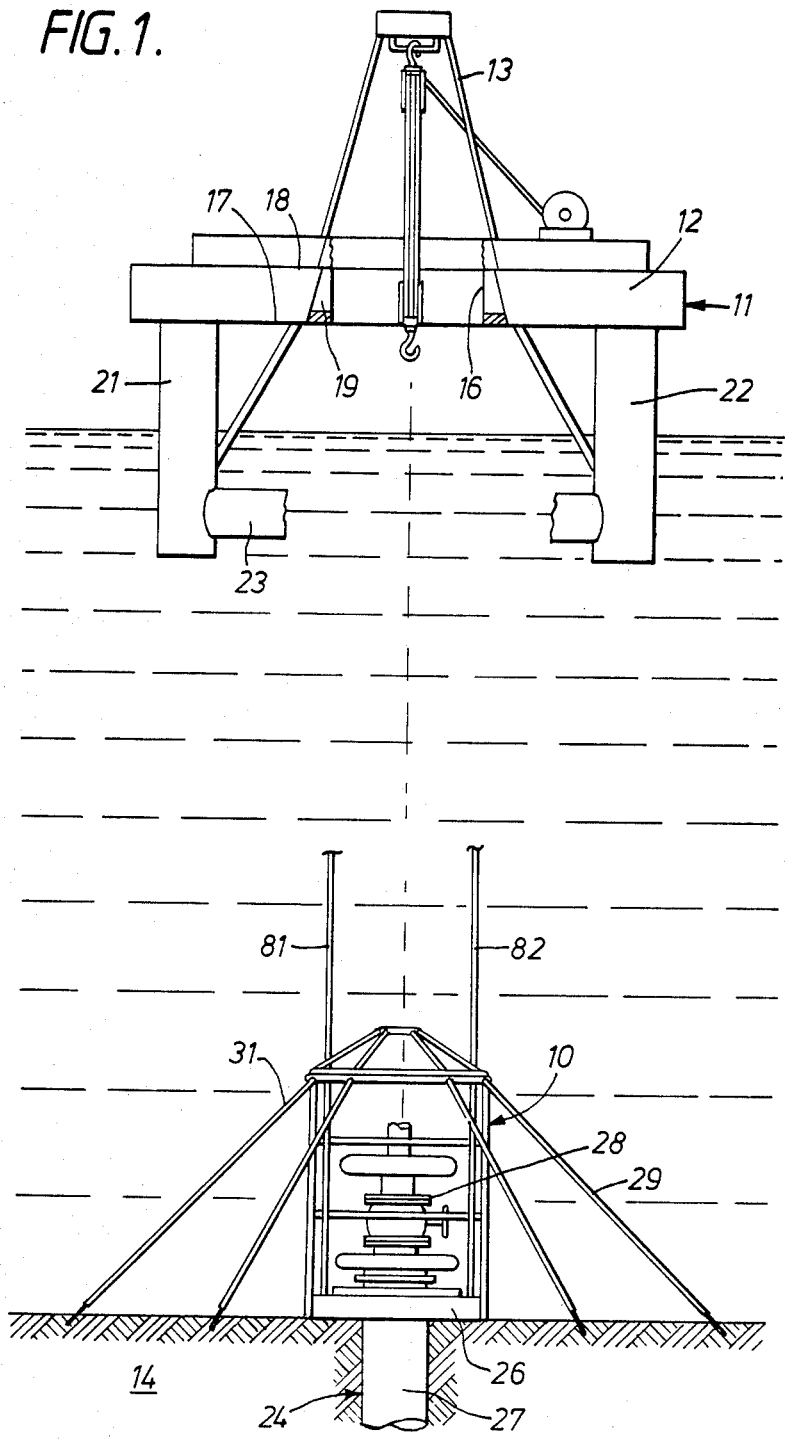
FIG. 1 is an environmental view of the disclosed well head protector in position encompassing a subsea well head.

As shown, drilling vessel 11 includes primarily a deck 12 which supports working equipment necessary to accomplish a drilling operation. The deck holds, for example, an upstanding derrick 13, as well as the usual rotary table and drive mechanism for the latter, which are operable to support a drill string for forming a well 15 into the ocean floor 14.

Deck 12 is provided with a vertical opening extending vertically therethrough providing direct access between derrick 13 and the surface of the water. Such an access or passageway is generally referred to in the industry as a moon pool.

Deck 12 is normally of sufficient height to embody a plurality of levels to facilitate a drilling operation. Thus, the deck presently contemplated consists of spaced apart upper and lower levels 17 and 18 which define a working section 19 therebetween.

Deck 12 is supported a controllable, variable distance above the water'surface by a plurality of upright buoyant columns 21 and 22. The latter can be supplemented with one or more pontoons 23 which extend parallel to deck 12, and are connected to the respective buoyant columns. The various columns and pontoons are provided with internal tanks and pumping means such that by varying the buoyancy thereof, the vessell 11 can be lowered or elevated in the water depending on whether it is operating, or is being transported. For drilling purposes, the deck is normally positioned about 50 or 60 feet above the water's surface.

At floor 14 of the body of water, well 24 is normally positioned comprising a pad 26 which rests on the floor and through which a well casing 27 depends. The latter extends downward into the substrate a sufficient distance to facilitate the placing of progressively decreasing size casing length to form an operative well.

The upper end of casing 27 is provided with a well head 28. The latter comprises primarily a series of cooperating control elements which are adapted to be manipulated whereby to controllably adjust the flow of the hydrocarbon, whether gas or crude oil, which is being produced through the well. Well heads of this type usually extend for about fifteen to twenty feet above pad 26 and are provided with external members such as valves, levers, etc. to effectuate the necessary fluid flow regulation.

Surrounding well head 28, is well head protector 10 comprising basically an open framework extending upwardly from pad 26 to define a partial closure. The latter is such that it permits free flow of water therethrough, and yet prevents contact of moving objects with well head equipment.

Protector 10 includes a plurality of outwardly extending elongated legs 29 and 31 which are connected to, and depend from the upper end of the protector, with their remote ends resting on the ocean floor. The respective legs thus define a sloping, discontinuous deflector surface. The latter functions to permit a moving object such as a ship's anchor chain or a trawl board to be slidably guided across the top of protector 10 rather than contacting the enclosed well head 28.

Figure 2:
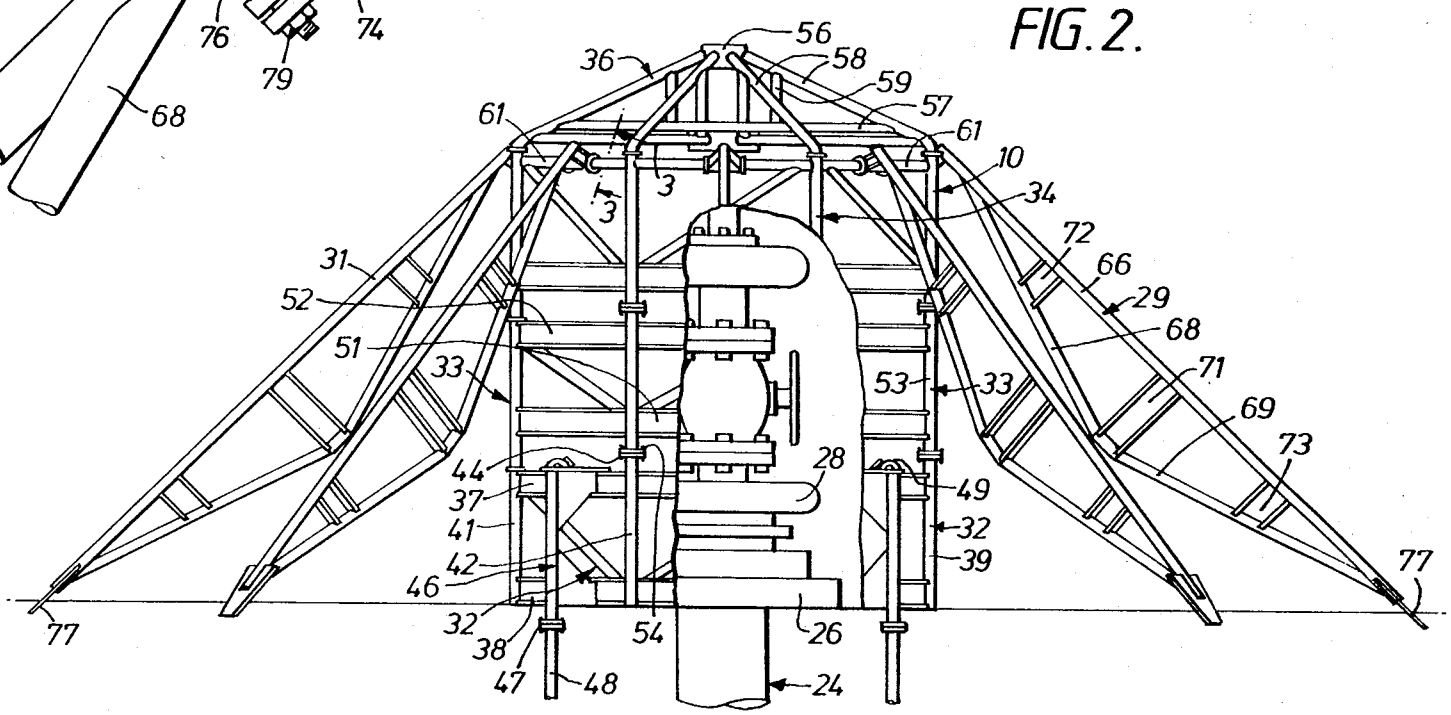
FIG. 2 is an enlarged elevation view of the well head protector with parts broken away.

Referring more specifically to FIG. 2, well head protector 10 is comprised primarily of a plurality of organized sub-assemblies. The latter, rather than being finally welded or assembled at a shore based fabricating yard, are shipped after trial assembly, as individual or discrete components to an offshore vessel such as shown in FIG. 1.

The respective sub-assemblies which comprise protector 10 include primarily a foundation sub-assembly 32 which in its resting position is supported at the ocean floor. A plurality of intermediate sub-assemblies 33 and 34 are stacked on top of the foundation sub-assembly 32. The several members are so connected to form a generally vertical unit which defines a central, open bottom enclosure therein.

The upper side of protector 10 is provided with a cap 36 which is removably engaged with intermediate sub-assembly 34. The plurality of deflector elements or legs 29 and 31 as noted above, are disposed about, and extend outwardly from sub-assembly 34 toward the ocean floor.

However, foundation sub-assembly 32 is comprised primarily of spaced apart upper and lower beams 37 and 38 respectively, which are arranged to define two substantially octahedral structures. The latter are connected by a plurality of upstanding columns 39 and 41 disposed about the respective beams whereby to lend sufficient support to maintain the unit as a base.

While the instant shape of intermediate sub-assembly 31 is presently shown as being octahedral, it can assume a variety of shapes including square or circular. In any instance, said member functions to support the respective legs 29 and 31 such that the latter define a generally radial pattern.

Foundation sub-assembly 31 is further provided with a plurality of upstanding connecting braces 42 and 43, each of which is provided at its upper surface with a connecting flange 44. The functions of the latter are to receive similar pads on the next, or intermediate sub-assembly 33, to facilitate connecting or bolting the two units into engagement.

Foundation sub-assembly 31 is further provided with a plurality of outboard stabbing piles 46 or similar members which extend downwardly from the lower surface of said sub-assembly. The stabbing piles 46 as shown are likewise provided with a connector flange 47 which is adapted to engage a comparable element to form an elongated downwardly extending stabbing finger 48. The function of the latter is to first contact the surface of the sub-sea location when the unit is lowered into place over a well head 28.

The stabbing piles 46 are spaced outwardly from the periphery of foundation member 32. The respective piles are further provided with a connecting eye 49 which accommodates support cables during unit assembly operation.

The interior space defined within the respective sub-assemblies members is open and defines an elongated upright passage capable of surrounding well head 28, as well as the well head pad 26.

The respective intermediate sub-assemblies 33 and 34 which are positioned adjacently upward of foundation member 32, are constructed similarly to said foundation member and are adapted to readily engage the latter at a series of connecting flanges. As a matter of structural expediency, the respective intermediate sub-assemblies define a generally octagonal interior shape, they can thus receive eight deflector elements 29 and 31 which are subsequently fastened thereto.

Each intermediary sub-assembly, such as 33, of which there can be any number, is comprised of spaced apart upper and lower beams 51 and 52 which are connected by circumferentially arranged vertical support columns 53. As in the instance of foundation sub-assembly 31, the column lower ends are fitted with connector pads or flanges 54. Thus, as the foundation sub-assembly 31, and the intermediate sub-assembly 32 are brought into vertical alignment, the respective connecting flanges 44 and 54 will be properly aligned, thereby permitting a bolting operation to join the two units.

Similarly to the foundation sub-assembly 32, intermediate sub-assembly 33 defines a central enclosure which is capable of surrounding well head 28. Further, the respective sub-assemblies are comprised of structural members which are so arranged to allow the free passage of water and small objects therethrough without attempting to establish a tight closure about any segment of well head 28.

The uppermost intermediary sub-assembly 34 is formed in essence substantially equivalent to sub-assembly 33. The upper end of said sub-assembly 34 is provided with a supporting ring 61 which extends about the periphery thereof. Said ring 61 comprises a hexagonal configuration formed of heavy round tubing. The function of said ring is to pivotally engage and support the upper extremity of the respective deflector legs 29 and 30.

As noted herein, the configuration of ring 61 is such as to readily accommodate the respective legs 29 and 31 in a preferred radial pattern.

Sub-assembly 34 is further provided about its upper surface, preferably at the end of the respective support columns, with upwardly facing sockets to removably register the corresponding, downwardly extending stabbing fingers of cap 36. Thus, when cap 36 is guidably lowered from the water's surface to well head 28, it can be properly aligned with and retained on said sub-assembly 34.

Cap 36 comprises an open framework formed primarily of concentrically disposed central ring 56, and outer ring 57. Said two rings are connected by a plurality of spoke-like struts 58 which define a series of upwardly sloping guide surfaces. Each strut can be provided with an underbrace 59 to assure rigidity thereof.

The outer or remote edges of two or more of the respective struts 58 are adapted to, or provided with a stabbing element 63 which slidingly engages the corresponding socket 62 of sub-assembly 34. Cap 36 can thus be maintained in place atop protector 10 merely by its own weight.

The respective outlying legs or deflectors 29 and 31 comprise an elongated main element 66 having an upper face. The latter defines a sliding contact surface along which fishing nets, anchor cables, or other elements can be readily deflected to avoid. contact thereof with well head 28. A longitudinal stiffening brace is disposed beneath the main element, and fastened to the opposed ends thereof. Said brace comprises a pair of tension members 68 and 69 having a plurality of supplemental ribs 71, 72 and 73 which are welded therebetween.

Figure 3:
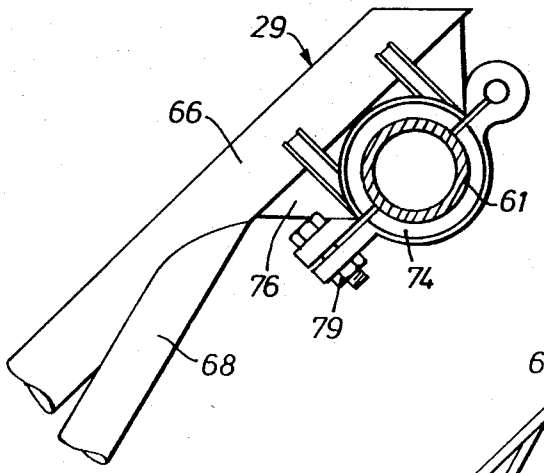
FIG. 3 is an enlarged segmentary view of the protector's leg connection.
Figure 4:
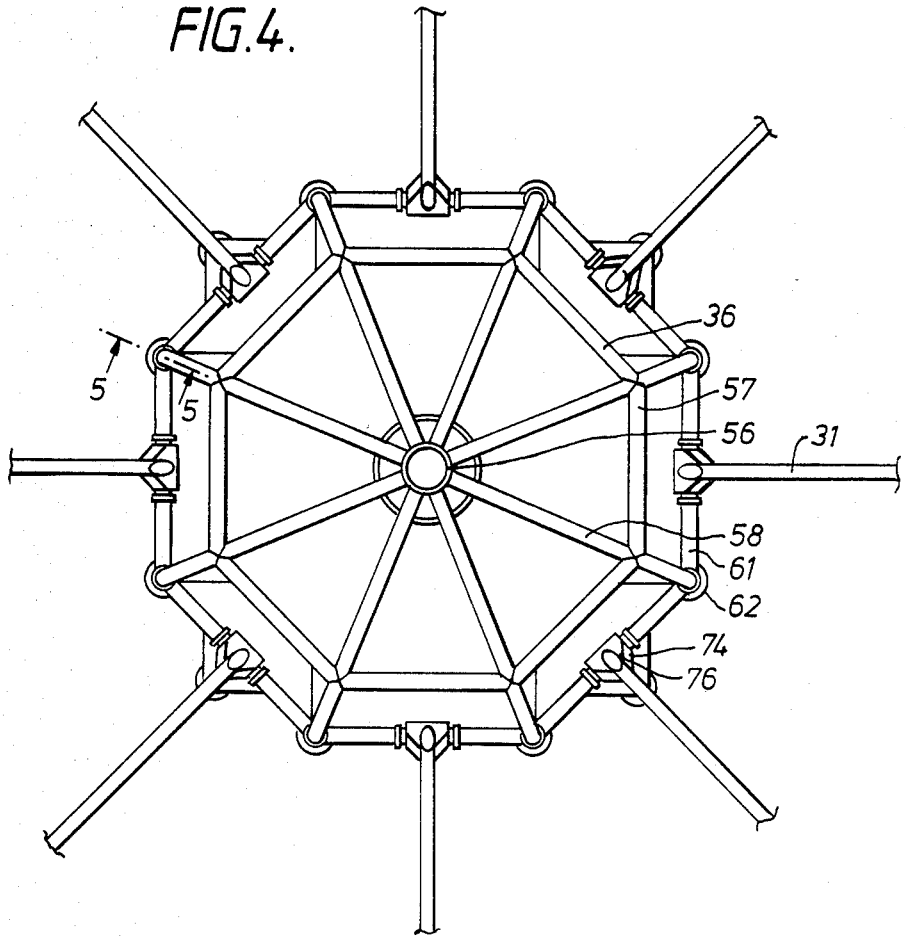
FIG. 4 is a top view of the protector shown in FIG. 2.
Figure 5:
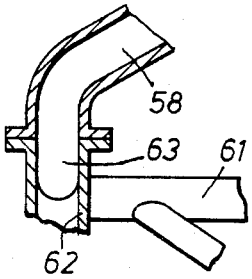
FIG. 5 is an enlarged view of a section of FIG. 4.
Figure 6:
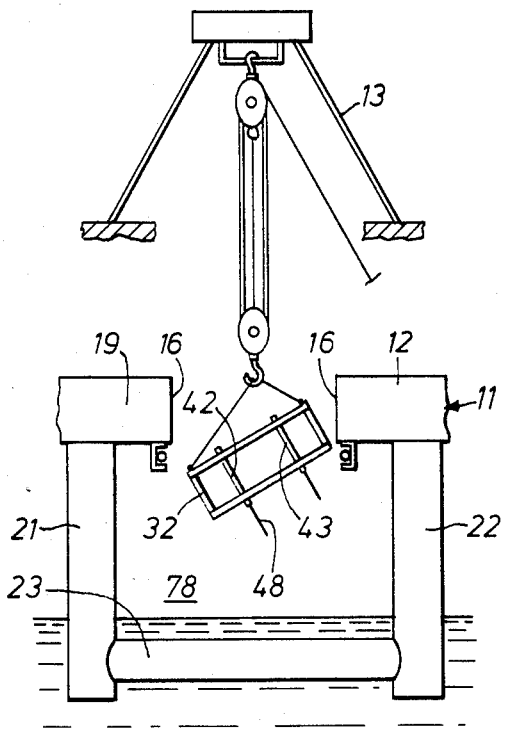
Figure 7:
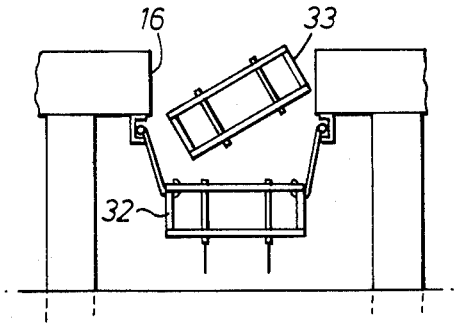
Figure 10:
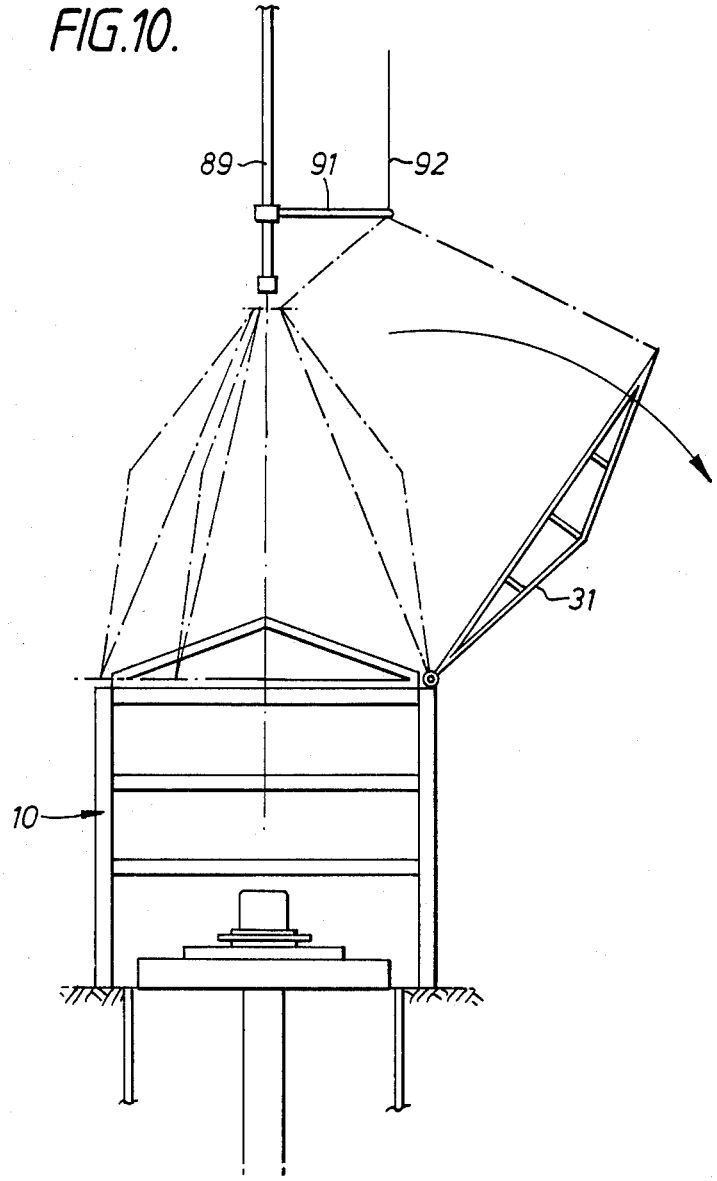

Leg 29 upper end is provided with a bearing means which operably engages support ring 61 of sub-assembly 34. Referring to FIG. 3, said bearing means includes a tubular sleeve 74 which is disposed normal to main element 68, and connected thereto with a bracket arrangement 76.

Sleeve 74 fits about support ring 61 with a sufficient degree of tightness to permit leg 29 to be rotatably adjusted about the ring after the protector unit 10 has been lowered into place at the sea bottom. Bearing means 74 can as shown, be comprised of a single tubular element. In the alternative, and preferably, it can comprise a split ring having a plurality of bolts holding it in place, a feature which will facilitate removal of the leg 29 from the protector in the event the leg becomes damaged.

In that one or more of the outstretched legs 29 or 31 can be snagged or otherwise entangled in chain, netting or the like, it may be advantageous to fabricate them to possess break away capability. Thus, each bearing member can be formed to break away from the leg structure when the bearing is subjected to excessive strain. The break away feature can be embodied in the bearing weldments or in connecting bolts 79 which hold the split bearing together.

The lower or remote end of the respective legs 29 and 31 is provided along main element 66 with a suitable fitting adapted to rest on or slightly penetrate slightly into the ocean floor. In the present arrangement, said remote element is comprised of an elongated plate 77 which extends concurrently with the main element to facilitate its entering the ocean floor to a limited degree when the legs are lowered into operating position.

INSTALLATION OF THE PROTECTOR

As previously noted, protector 10 is finally assembled in condition for lowering to the ocean floor at drilling vessel 11 which is anchored, or otherwise fixedly positioned above a well head site. However, prior to being so assembled, the entire unit is initially fabricated into a singular structure at a land based shipyard or similar facility. Thus, the entire unit including foundation 32, the various intermediary sections 33 and 34, as well as cap 36 and the respective legs 29 and 31, can all be provisionally preassembled at the point of fabrication without actually being permanently joined by bolting or welding. This will assure a minimal degree of fitting problems when the unit is subsequently assembled on site.

When it has been determined that the respective protector parts are properly made, adjusted and engaged, the unit is disassembled into discrete and individual elements.

Each of said discrete elements is of such magnitude that it can be readily transferred to a barge or other marine vehicle for transport to drilling vessel 11. Because the protector elements are relatively small, in contrast to the assembled unit, they are adapted to be handled on board by the vessel's crane and derrick mechanisms. The individual protector members are marshalled in the intermediary working space 19 between the vessel's deck 12 upper and lower levels.

Because of the limited access area in this working space, the respective individual protector members are lowered sequentially, and unconnected down through moon pool 16. They are then suspended by cables or chains within opening 78 between the undersurface of deck 12 and the water's surface.

Referring to FIGS. 6 through 10, while not shown in specific detail, the various parts of the protector 10 are illustrated graphically to illustrate their relative positions with respect to working deck 12, as the individual protector members are lowered toward the water. It is further understood that the normal offshore drilling vessel 11 embodies a number of derricks, cranes, gantries, winches and the like, all of which would be utilized in manipulating the individual protector parts to their proper disposition whereby to best be lowered through moon pool 16.

As here shown, the foundation element 32 is initially lowered from deck 12 at an appropriate angle to the horizontal to permit its free passage through moon pool 16. At a point below deck, yet above the water's surface, foundation member or sub-assembly 32 is adjusted to a substantially horizontal position. A plurality of cables 81 and 82 extend from pad eyes 49, to deck members, whereby to maintain the foundation member in position, and yet stabilizing it from undesired movement.

With the foundation 32 in place, the intermediary sub-assembly 33 is similarly maneuvered and passed through the moon pool 16 to align the various connecting flanges 44 on the respective members 32 and 33 with each other. When proper alignment has been achieved, the two members are bolted together at the aligned connecting flanges.

To accommodate the entire protector unit, foundation sub-assembly 32 is lowered toward the water and supported in a horizontal disposition a safe distance above the surface thereof. After sub-assembly 34 is lowered to engage the upper surface of sub-assembly 33, protector 10 has now substantially achieved its working height.

As previously noted, the overall well protector unit 10 can comprise any number of discrete horizontal subsections or sub-assemblies which are fastened one to the other to achieve the desired coverage of a particular well head. Thus, as the sub-assemblies are sequentially added to the protector upper end, the lower end is progressively lowered toward the water.

With the cap 36 lowered onto the protector and fitted into place on member 34, the protector 10 is ready to accommodate the respective elongated legs 29 and 31.

As shown in FIG. 8, the respective elongated legs are initially lowered through moon pool 16 and assembled to protector 10 in a substantially upright position. Each leg's bearing member is pivotally and slidably carried on a segment of ring 61. In the present embodiment, ring 61 is segmented as noted into eight parts, each part being adapted to receive one leg connector.

With the eight legs commonly sustained in an upstanding position, the unit is in condition to be lowered onto a well head 28 at the ocean floor. However, to facilitate the lowering operation, guide lines 86 and 87 are provided which extend from the vessel 11 to the well head pad 26.

In one embodiment, said guide means as shown can include a plurality, and preferably four parallel cables, which are connected to pad 26, or anchored to positions adjacent thereto. The cables extend in a parallel direction upwardly toward the vessel 11 and are maintained in a taut condition by a winch in combination with heave compensators. The buoyancy of vessel 11 can, if need be, be adjusted to either elevate it or lower it into the water thus assuring the integrity of the guide system.

To facilitate the lowering of the now fully assembled protector 10, the drilling vessel's derrick 13 can be utilized by positioning it directly over moon pool 16. Thus, derrick 13 is provided with a suitable fixture including drill string 89 to extend downwardly through the upstanding and fastened deflector legs 29, 31, and into the protector.

The lowering operation is commenced by registering the various guide cables 81 and 82 with comparably spaced guide sleeves on protector 10. The latter can include judiciously placed split sleeves so that the cable can be removed and retrieved to the surface.

Although the protector 10 includes a number of downwardly depending stabbing fixtures 83, it can also include pile guides for subsequently piling the protector in place at the ocean floor.

To facilitate dispersal of the upstanding legs, drill string 89 is provided with a boom 91. The latter depends outwardly from the drill string a distance above the grouped legs' ends.

When the protector is properly lowered to register about well head 28, the respective legs can be lowered in sequence to the floor with diver assistance. Thus, each leg in order is removably connected at its lower end to a spring cable 92 and released from the remaining legs. The cable is slidably carried at the remote end of boom 91. By applying tension to cable 92, a leg 29 will be displaced outwardly and thence pivotally lowered to the floor.

The diver can now disconnect the spring cable from the lowered leg, and apply it to the next leg. With all the legs lowered into place, the respective legs can be fastened to ring 61 and the protector made operational.

Although modifications and variations of the invention may be made without departing from the spirit and scope thereof, only such limitations should be imposed as are indicated in the appended claims.

We claim:

1. A protective structure for encompassing an upstanding well head located at the floor of a body of water to preclude encounter between the well head and submerged objects which might be brought into damaging contact therewith, which structure includes;

an elongated open framework of structural members which defines a quasi-enclosed area adapted to surround the well head, said open framework including a foundation sub-assembly which is supported at the ocean floor and having connecting flanges thereon, at least one intermediate sub-assembly in engagement with the foundation sub-assembly at said connecting flanges, and at least one deflector element extending laterally from the uppermost of said at least one intermediate sub-assembly to rest at the ocean floor a sufficient distance from the foundation member whereby to define an upward sloping deflector surface which terminates at the upper end of the protective structure.

2. In the apparatus as defined in claim 1, wherein said at least one deflector element comprises at least one elongated leg having one end thereof attached to the said uppermost intermediate sub-assembly, and the leg other end being disposed at the ocean floor spaced from said foundation member.

3. In the apparatus as defined in claim 1, wherein said at least one deflector element includes a plurality of elongated legs, each thereof having the upper end attached to said intermediate sub-assembly and the legs' respective other ends being spaced radially about the foundation sub-assembly.

4. In the apparatus as defined in claim 1, wherein said at least one deflector element is operably engaged with the uppermost of said intermediate sub-assemblies.

5. In the apparatus as defined in claim 4, wherein said at least one deflector element includes a plurality of elongated legs, each thereof having the upper end attached to said intermediate sub-assembly and each said leg being operably movable independent of each other leg.

6. In the apparatus as defined in claim 5, wherein said respective elongated legs are spaced substantially equidistant about said protective structure.

7. In the apparatus as defined in claim 1, including a cap removably engaging the uppermost of said intermediate sub-assemblies to allow access to the encompassed well head when said cap is removed.

8. In the apparatus as defined in claim 7, wherein said cap includes; a plurality of radial struts, which extend from the cap outer edge and terminate adjacent to the deflector element whereby to define a continuation guide surface to the upwardly sloping deflector surface.

9. In the apparatus as defined in claim 2, wherein said elongated leg includes; an elongated stinger, a clamping means at one end thereof adapted to operably engage the said intermediate sub-assembly, and to be fixedly adjusted when the leg is in operating position at the ocean floor.

10. In the apparatus as defined in claim 2, wherein said elongated leg includes; an elongated stinger which defines said deflecting surface, and the support brace disposed therebeneath.

11. In the apparatus as defined in claim 1, wherein said uppermost intermediary sub-assembly includes; a multi-segment generally horizontal peripheral ring at the top side thereof, and said means forming said deflector element depends from said peripheral ring.

12. In the apparatus as defined in claim 11, wherein said deflector leg is attached to each of said peripheral ring segments.

13. In the apparatus as defined in claim 3, wherein the respective legs are pivotally operable about the upper end to assume a generally vertical disposition.

14. In the apparatus as defined in claim 1, including; means to fixedly position the foundation sub-assembly to the ocean floor.

15. In the apparatus as defined in claim 14, including; means in said foundation sub-assembly to receive a pile which is insertable into the ocean floor when said foundation member is properly positioned with respect to said well head.

16. In the apparatus as defined in claim 15, wherein said connecting pads on the respective foundation and intermediate sub-assemblies include bolt holes adapted to receive a fastening bolt when the respective pads are brought into vertical alignment.

17. Method for installing a well head protector structure 10 about a submerged well head 28 at the floor of an offshore body of water, from a drilling vessel 11 having a deck 12 which is elevated above the water's surface to define an intermediary space between the deck and the said water's surface, and a drilling derrick 13 positioned above said deck, which method includes the steps of;

marshalling on the deck 12 of said vessel 11 the discrete sub-assemblies which, when engaged together, make up the well head protector structure 10, sequentially lowering the respective sub-assemblies from said deck 12 into the intermediate space above the water, and engaging the discrete sub-assemblies into a unitary protector structure, guidably lowering the unitary protector structure 10 to the floor 14 of said body of water, whereby to register about said submerged well head 28.

18. Method as defined in claim 17, wherein said discrete sub-assemblies include at least one deflector leg 29, which is operably engaged to the unitary structure 10, prior to the latter being lowered onto the well head 28.

19. Method as defined in claim 17, wherein said discrete sub-assemblies include a plurality of deflector legs 29 and 31 which are each operably engaged at peripherally spaced intervals to the upper end of the unitary structure prior to the latter being lowered to the well head.

20. Method as defined in claim 18, wherein the discrete sub-assemblies include a plurality of elongated deflector legs, each of which is operably connected at one end thereof to the upper end of the unitary structure.

21. Method as defined in claim 17, including the steps of; providing a guide means which extends from the said vessel 11 to the subsea well head 28, and operably attaching the unitary protector structure to said guide means prior to lowering the structure to the subsea well head.

22. Method as defined in claim 21, including the steps of; extending a plurality of cables between the vessel 11, and well head 28, and slidably engaging the unitary protector structure with said cables.

23. Method as defined in claim 17, including the step of; suspending the unitary structure 10 from the drilling derrick 13 on said vessel, prior to guidably lowering said unitary structure into registry with the subsea well head 28.

24. Method as defined in claim 21, wherein the operably engaged legs 29 and 31 are disposed in a generally vertical disposition as unitary structure 10 is lowered into registry with well head 28, said legs being thereafter pivotally displaced downwardly to bring the remote ends thereof into contact with said floor 14.

* * * * *